US006186155B1

(12) United States Patent
Cheek

(10) Patent No.: US 6,186,155 B1
(45) **Date of Patent: *Feb. 13, 2001**

(54) SPA TOWEL

(76) Inventor: David Alan Cheek, 5125 F St., Southeast, Washington, DC (US) 20019-6026

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 41 days.

(21) Appl. No.: 09/304,041

(22) Filed: May 4, 1999

(51) Int. Cl.[7] ..... B08B 7/00
(52) U.S. Cl. ..... 134/6; 15/209.1; 15/210.1
(58) Field of Search ..... 15/209.1, 210.1; D6/608, 609; 134/6

(56) References Cited

U.S. PATENT DOCUMENTS

| | | | | |
|---|---|---|---|---|
| D. 330,140 | | 10/1992 | Lerner . | |
| D. 339,951 | * | 10/1993 | Parkison | D6/608 |
| D. 347,542 | | 6/1994 | Sheppard, Jr. . | |
| D. 363,404 | | 10/1995 | Cute . | |
| D. 385,742 | | 11/1997 | Bird . | |
| D. 414,645 | * | 10/1999 | Cooper | D6/608 |
| 2,754,532 | * | 7/1956 | Kanehl . | |
| 3,115,639 | * | 12/1963 | Moszczynski . | |
| 3,938,570 | * | 2/1976 | Stewart . | |
| 4,403,366 | * | 9/1983 | Lucke . | |
| 4,885,195 | * | 12/1989 | Change, III . | |
| 4,912,800 | * | 4/1990 | Zeltner | 15/210.1 |
| 5,012,543 | * | 5/1991 | Lewis, Sr. | 15/209.1 |
| 5,018,229 | | 5/1991 | Eberhart . | |
| 5,060,943 | * | 10/1991 | Stoffo . | |
| 5,072,467 | * | 12/1991 | Hunt . | |
| 5,147,703 | * | 9/1992 | Provost | D6/608 |
| 5,331,705 | | 7/1994 | Melov . | |
| 5,394,914 | | 3/1995 | Meek . | |
| 5,443,880 | | 8/1995 | Wike . | |
| 5,724,698 | | 3/1998 | Mondragon . | |
| 5,761,761 | | 6/1998 | An . | |

OTHER PUBLICATIONS

"Handsome Rewards" Feb. 1992; *Mc Divot's Golf Towel With Brush.**

* cited by examiner

*Primary Examiner*—Randall E. Chin
(74) *Attorney, Agent, or Firm*—Applicant Pro Se

(57) ABSTRACT

Color is used to divide a towel (8) into sections. A larger section (10) lay adjacent to a smaller section (12). The larger section (10) is designated to remove perspiration from the user's face/body while the smaller section (12) is designated for the user to remove perspiration from fitness machines. Furthermore, an arrangement to retain small, personal belongings may be provided by either a retaining device (14), or a storage pocket (22).

1 Claim, 2 Drawing Sheets

SPA TOWEL

CROSS-REFERENCE TO RELATED APPLICATIONS

Not Applicable.

STATEMENT REGARDING FEDERALLY SPONSORED RESEARCH AND DEVELOPMENT

Not Applicable.

REFERENCE TO A "MICROFICHE APPENDIX"

Not Applicable.

BACKGROUND OF THE INVENTION (1) Field of the Invention

This invention relates to the towel and its role in the health and fitness industry.

(2) Description of the Related Art

A health club provides an ideal atmosphere for its members to pursue personal health and fitness goals. The communal characteristics associated with membership spawn many friendships as fellow members find themselves sharing a limited number of fitness machines. As peak volumes are reached, however, members are faced with a multitude of health hazards. The focus of the present invention is to provide its users a safeguard, with respect to perspiration, as they pursue personal health and fitness goals.

Prior art reveals the need for a towel specifically designed for golfers, health club patrons, and beach goers alike. For instance, U.S. Pat. No. 5,018,229 to Eberhart (1991) discloses a beach towel which includes pockets at the corners and a weight in a sealed package for each pocket; U.S. Des. Pat. No. 330,140 to Lerner (1992) discloses an ornamental design for a towel having an inside pocket to wipe off golf clubs and balls; U.S. Des. Pat. No. 347,542 to Sheppard, Jr. (1994) discloses an ornamental design for a combined towel and fastener; U.S. Pat. No. 5,331,705 to Melov (1994) discloses a cleaning aid comprised of a towel having a cleaning cloth stitched over part of its area and a fibrous scouring pad stitched over part of the cloth; U.S. Pat. No. 5,443,880 to Wike (1995) discloses a beach towel or blanket with pockets that have integral closures lined with waterproof or water-repellant material; U.S. Pat. No. 5,394,914 to Meek (1995) discloses a combined wiper and head cover for a golf club, including a club head scrubber, and the method for applying the cover to the club and in particular the putter; U.S. Des. Pat. No. 363,404 to Cute (1995) discloses an ornamental design for a golfer's towel having terry cloth and chamois portions; U.S. Des. Pat. No. 385,742 to Bird (1997) discloses an ornamental design for a workout towel detailing artwork in the lower portion; U.S. Pat. No. 5,724,698 to Mondragon (1998) discloses a pocketed towel equipped with an adjustable strap for securing said towel to golf and gym equipment/apparatus; U.S. Pat. No. 5,761,761 to An (1998) discloses a tri-sectioned, multipurpose golf towel comprising two sides of fabric, one side made of an absorbent material such as terry cloth, and the other side made of a more coarse material.

While the above mentioned items are all towel-related, some are multifunctional, and a handful are merely ornamental. However, none of them introduces color as a discriminatory factor between two sections of the same material.

BRIEF SUMMARY OF THE INVENTION

In accordance with the present invention, an opportunity to take sanitary measures while sharing the use of fitness machines with fellow club members is established when color is used to differentiate portions of a towel, and an arrangement to retain small items is provided by either a retaining device, or a storage pocket. One portion of the towel is clearly designated to remove perspiration from the user's face/body, while the remainder is designated to remove perspiration from fitness machines. Furthermore, an opportunity to retain small, personal belongings may be provided by a retaining device, or a personal storage pocket.

Accordingly, the object of this invention is to provide its users with an opportunity to discriminate which part of a towel was used to remove the perspiration from his/her body versus the same on fitness machines. Also, an additional object is to provide an opportunity to retain, with the towel, personal belongings such as, for example, identification, a wrist watch, loose change, a set of keys, etc.

Accordingly, the advantages of this invention are for its users to take a sanitary approach while sharing the use of fitness machines with fellow club members and the theft prevention of personal belongings while working out.

The objects and advantages of the present invention will become apparent from a consideration of the drawings and ensuing description.

DETAILED DESCRIPTION OF THE INVENTION

Figure 1:
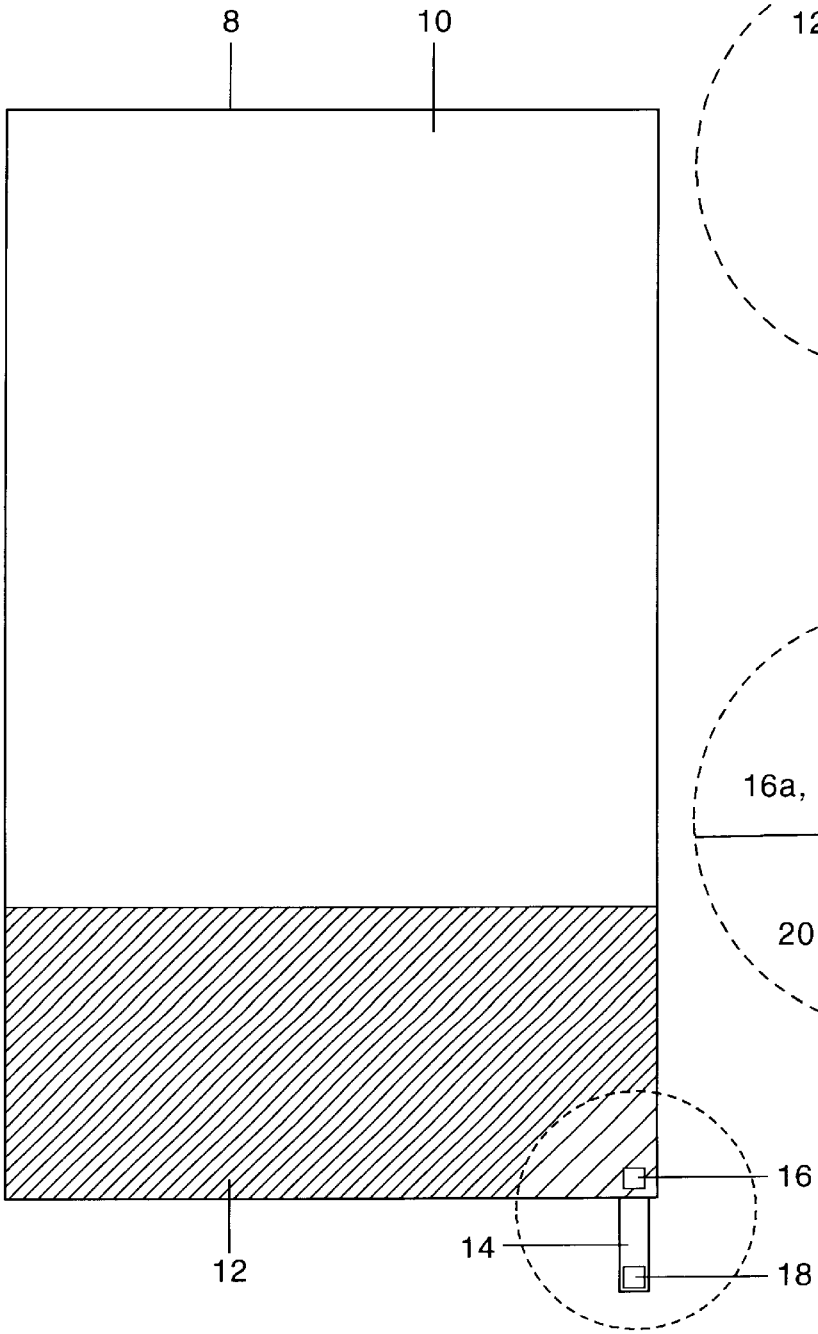
FIG. 1 shows a plan view of my invention (preferred embodiment).
Figure 2:
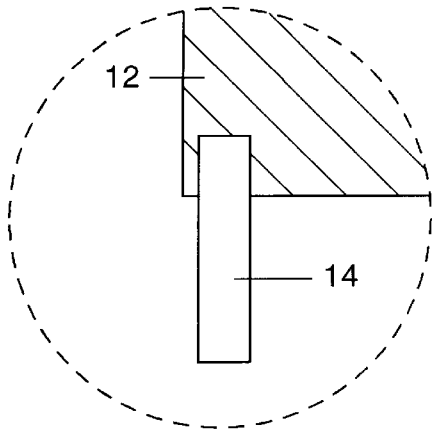
FIG. 2 is a rear, partial view of the portion indicated in FIG. 1.

A preferred embodiment is presented in FIG. 1 (plan view) where color is used to divide a towel 8 into sections. A larger section 10 lay adjacent to a smaller section 12. The smaller section 12 is adjoined by two components. One component is a hook fastener 16 and is sewn into the frontal portion of said smaller section 12. The other component, a retaining device 14, is a strip of the same cloth used in said smaller section 12, sewn in mirror image of hook fastener 16, but into the rear portion (see FIG. 2) of said smaller section 12. A loop fastener 18, is sewn into the frontal portion, yet at the opposite end of said retaining device 14.

As shown in FIG. 1, the larger section 10 is designated for the user to remove perspiration from his/her body, while the smaller section 12 is designated for the user to remove perspiration from fitness machines. The use of color plays a key role in enabling the user to easily discriminate between the two.

Figure 3:
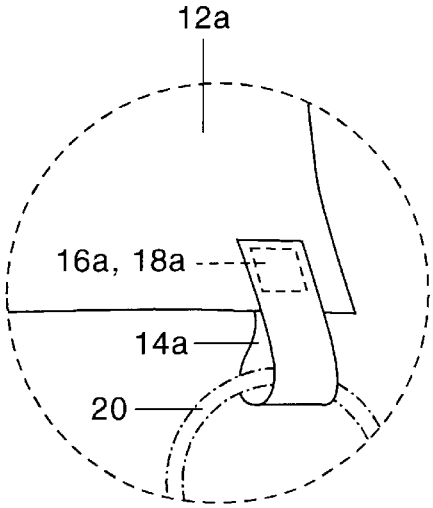
FIG. 3 is a detailed operational view of the portion indicated in FIG. 1.

FIG. 3 exemplifies how a retaining device 14*a* creates an enclosure when hook and loop fasteners, 16*a* and 18*a* respectively, are joined. This bonding process enables said retaining device 14*a* to interlock with such items as a key ring 20. The key ring 20 appears in FIG. 3 only as an example to demonstrate the operational means of the interlocking process that occurs when the retaining device 14*a* is in use. Therefore, the key ring 20 does not appear in FIG. 1, the preferred embodiment, and is not an inclusion of the present invention.

Figure 4:
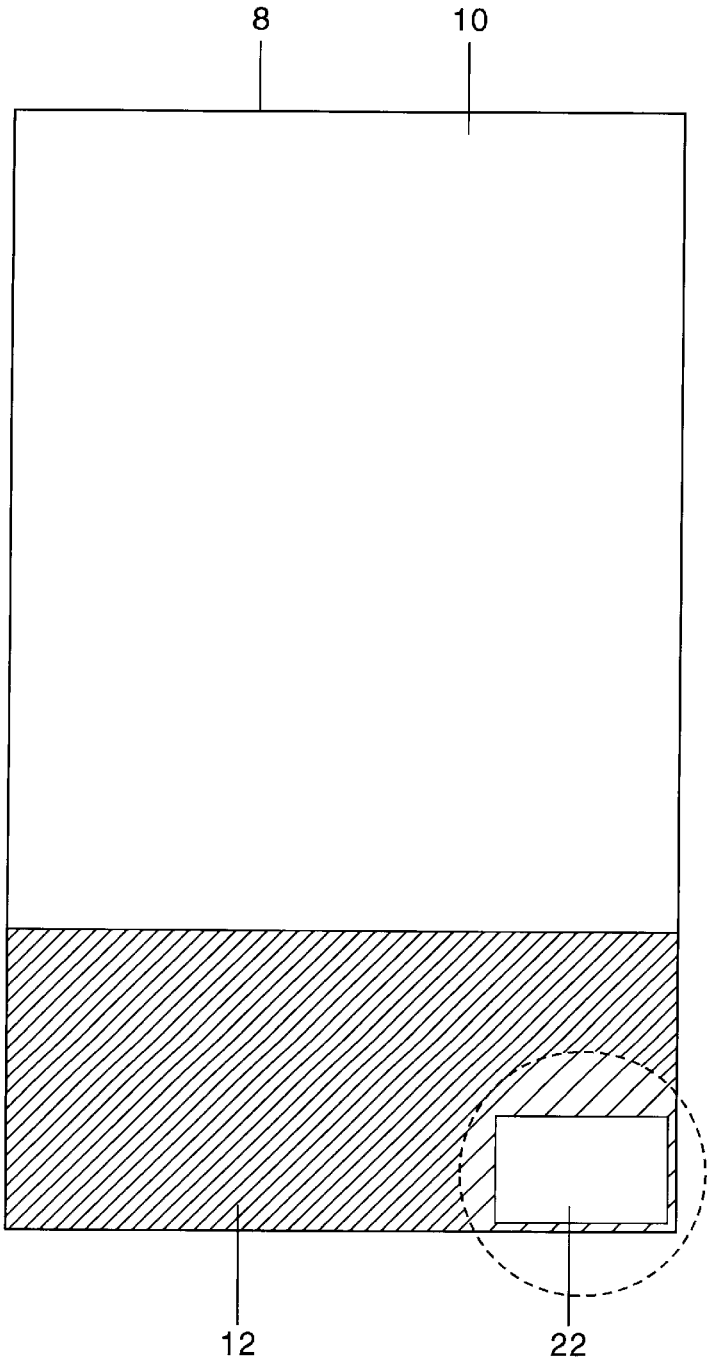
FIG. 4 shows a plan view of my invention (alternative embodiment)

An alternative embodiment is presented in FIG. 4 (plan view) where three sides of a rectangular cut of the same cloth used in said smaller section 12 are sewn into the frontal portion of said smaller section 12, thus creating a pocket 22. Underneath the upper, unsewn side of said cut of cloth, yet sewn into said smaller section 12, is a hook fastener 24. Underneath the upper, unsewn side, yet sewn into same cut of cloth, and in mirror image of said hook fastener 24, is a loop fastener 26.

Figure 5:
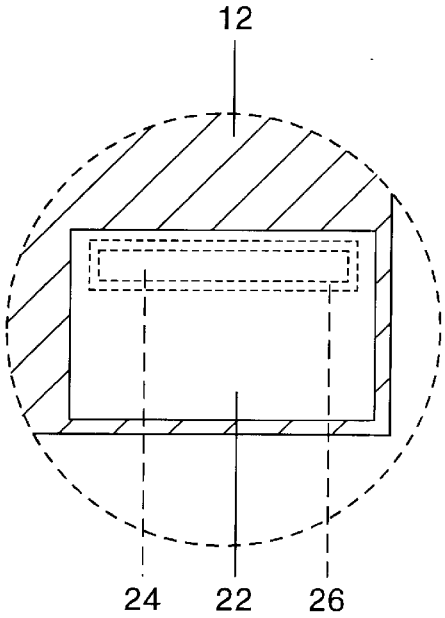
FIG. 5 is a partial view of the portion indicated in FIG. 4.

FIG. 5 illustrates how a pocket 22 is secured when hook and loop fasteners, 24 and 26 respectively, are joined. Said pocket was designed to store personal belongings such as, for example, identification, a wrist watch, loose change, a set of keys, etc.

Thus the reader shall see that the present invention provides the user with a means to take sanitary measures while sharing the use of fitness machines with his/her fellow club members. No longer will he/she leave to speculation which part of the towel was used to remove perspiration from his/her body versus fitness machines. Also, for those not willing to part with small, personal belongings, a choice of two viable options is available: The first, being a retaining device; the second, a personal storage pocket.

While my above invention contains several specificities, these should not be construed as limitations on the scope of the invention, but rather as an exemplification of preferred embodiments thereof. Many other variations are possible. For example, the interlocking process achieved by the retaining device can easily be accomplished by implanting a ring, albeit metal, plastic, or otherwise; the cloth of the retaining device can be replaced with any material capable of wrapping to complete an enclosure such as rubber, leather, chain link, etc.; the hook and loop fasteners of said retaining device can be replaced by any means of fastening device such as snaps, buttons, magnets, etc.; the cloth of the storage pocket is not limited to being rectangular in shape, but can take on any number of shapes such as a square, a circle, a triangle, etc., and can be made with any material such as leather, rubber, vinyl, plastic, etc.; the hook and loop fasteners for the storage pocket can be replaced by any means of fastening device such as zippers, snaps, buttons, magnets, etc.; the positions of hook and loop fasteners can easily be transposed while yielding the same results in either application (retaining device or storage pocket).

Thus the scope of the invention should be determined not by the embodiments illustrated, but by the appended claims and their legal equivalents.

What is claimed is:

1. A method for health and fitness spa patrons to take sanitary measures while sharing the use of fitness machines with fellow club members, comprising the steps of:

(a) providing a towel, having a differentia of portions specifically identified for application to different surfaces, wherein each said portion includes a visibly distinctive feature to divide said towel into function-specific portions;

(b) allocating one of said function-specific portions for application to remove perspiration from a user's face/body, and allocating another of said function-specific portions for application to remove perspiration from fitness machines;

whereby a user can easily discriminate which of said function-specific portions of said towel is designated for application to his/her perspiration versus the same on fitness machines, and thereby affording prospective users a means to take sanitary measures while sharing the use of fitness machines with fellow club members.

* * * * *